US007898230B2

(12) United States Patent
Lee et al.

(10) Patent No.: US 7,898,230 B2
(45) **Date of Patent: *Mar. 1, 2011**

(54) LOW DROP OUT VOLTAGE REGULATOR CIRCUIT ASSEMBLY

(75) Inventors: Chang-Hyeon Lee, Irvine, CA (US); Joshua Cho, Irvine, CA (US); Pete Good, Dana Point, CA (US)

(73) Assignee: Skyworks Solutions, Inc., Woburn, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/471,515

(22) Filed: May 26, 2009

(65) Prior Publication Data

US 2009/0231024 A1 Sep. 17, 2009

Related U.S. Application Data

(63) Continuation of application No. 11/740,965, filed on Apr. 27, 2007, now Pat. No. 7,554,306.

(51) Int. Cl.
*G05F 1/40* (2006.01)
*G05F 5/00* (2006.01)

(52) U.S. Cl. ..... 323/273; 323/303

(58) Field of Classification Search ..... 323/268, 323/270, 271, 273, 275, 276, 281, 299, 303
See application file for complete search history.

(56) References Cited

U.S. PATENT DOCUMENTS

| | | | | |
|---|---|---|---|---|
| 5,610,504 | A * | 3/1997 | Tsugita | 323/283 |
| 5,748,010 | A | 5/1998 | Haque | |
| 6,091,235 | A | 7/2000 | O'Neill | |
| 6,118,266 | A | 9/2000 | Manohar et al. | |
| 6,225,857 | B1 | 5/2001 | Brokaw | |
| 6,703,813 | B1 | 3/2004 | Vladislav et al. | |
| 7,091,710 | B2 | 8/2006 | Yang et al. | |
| 7,106,033 | B1 | 9/2006 | Liu et al. | |
| 7,253,596 | B2 | 8/2007 | Yamamoto et al. | |
| 7,317,302 | B1 * | 1/2008 | Collins | 323/222 |
| 7,598,715 | B1 * | 10/2009 | Hariman et al. | 323/271 |

OTHER PUBLICATIONS

Nebel et al., A Very Low Drop Voltage Regulator Using an NMOS Output Transistor, IEEE International Symposium on Circuits and Systems 2005, May 2005, vol. 4, pp. 3857-3860.
Excerpts from the file history of U.S. Appl. No. 11/740,965, filed Apr. 27, 2007, 13 pages.

* cited by examiner

*Primary Examiner* — Matthew V Nguyen

(57) ABSTRACT

An integrated circuit assembly includes a voltage level generator, a level shifter, a bandgap reference generator and a voltage regulator. The voltage level generator generates output voltage level signals in response to a supply voltage. The level shifter receives the output voltage level signals from the voltage level generator and generates first and second sets of control signals. The bandgap reference generator receives a reference voltage input and generates a bandgap reference signal. The voltage regulator receives a supply voltage, the bandgap reference signal the first and second sets of control signals from the level shifter and generates a constant output voltage under varying circuit conditions.

21 Claims, 6 Drawing Sheets

LOW DROP OUT VOLTAGE REGULATOR CIRCUIT ASSEMBLY

This application is a continuation of and claims priority to U.S. nonprovisional patent application entitled, "Low Drop Out Voltage Regulator Circuit Assembly," having Ser. No. 11/740,965, filed on Apr. 27, 2007, which issued as U.S. Pat. No. 7,554,306 on Jun. 30, 2009, and which is entirely incorporated herein by reference.

BACKGROUND OF THE INVENTION

This invention relates generally to a low drop out (LDO) voltage regulator that enables reliable long-term operation over a wide range of input voltages. More particularly, the invention relates to a circuit architecture that enables reliable, long-term, voltage regulation over a wider range of input voltages.

A low dropout or LDO regulator is a voltage regulator which has a very small input-output differential voltage. The main components of a LDO voltage regulator are a power transistor and a differential amplifier (sometimes known as an error amplifier). One input of the differential amplifier monitors a portion of the output, as determined by a ratio of two resistances. A second input to the differential amplifier is from a stable voltage reference (commonly referred to as the bandgap reference). When the output voltage rises too high relative to the reference voltage, the drive to the power transistor changes so as to maintain a constant output voltage.

A voltage regulator's dropout voltage determines the lowest usable supply voltage. If, for example, the LDO voltage regulator has a dropout voltage around 700 mV (0.7V), a 3.3V output would require the input to be at least 4.0V. Such a LDO voltage regulator may be specified to provide a fixed 3.3V output with a 4.0V to 5.5V input voltage range.

A LDO voltage regulator's output voltage varies in accordance with several factors. For example, output voltage of an LDO voltage regulator can be affected by variation in the temperature of the constant voltage reference source and the differential amplifier characteristics, as well as variation in the tolerances of individual sampling resistors.

The use of small geometry and low-voltage devices (i.e., devices that reliably operate when the voltage across any two transistor terminals is less than a relatively low maximum voltage) is the trend in advanced integrated circuits (ICs). These low-voltage digital-logic devices consume less power and can be reliably operated at higher clock rates. Accordingly, low-voltage devices are used in a number of battery-operated portable electronic systems. Intermediate voltage-level devices (i.e., devices that reliably operate when the voltage across any two transistor terminals is less than approximately 3V) are generally used in ICs that require analog functions. Even higher voltage levels are required by some circuits used in both analog and digital functional blocks related to system interfaces and other functions, such as those required by wireless communication devices. One way to accommodate these higher voltages is to use transistors designed to operate reliably at corresponding higher voltage levels. For example, transistors where the voltage across any two transistor device terminals can be 5V without reliability issues (i.e., 5V transistors) can be used to implement functions over a range of voltages from 0V to about 5V. This solution requires a second IC or the addition of devices designed to manage these higher voltages when the bulk of IC functionality is provided via a first IC that uses lower-voltage devices. Accordingly, ICs using higher-voltage transistors in addition to low-voltage devices result in increased cost and complexity for the final product.

Typically, IC manufacturers do not provide a product that combines low-voltage digital transistors, 3V analog input/output transistors and 5V or higher analog/power transistors using a single manufacturing process. Accordingly, there would be a significant cost associated with using and developing a semiconductor wafer manufacturing process that could provide the desired combination of transistors on a single IC.

Therefore, it would be desirable to provide a low cost, reliable and integrated LDO voltage regulation solution that can be implemented using existing semiconductor manufacturing process technologies.

SUMMARY

One embodiment of an integrated circuit assembly comprises a voltage level generator, a level shifter, a bandgap reference generator and a voltage regulator. The voltage level generator generates output voltage level signals in response to a supply voltage. The level shifter receives the output voltage level signals from the voltage level generator and generates first and second sets of control signals. The bandgap reference generator receives a reference voltage input and generates a bandgap reference signal. The voltage regulator receives a supply voltage, the bandgap reference signal the first and second sets of control signals from the level shifter and generates a constant output voltage under varying circuit conditions.

One embodiment of a method for improving the operating supply voltage range of an integrated-circuit based voltage regulator comprises the steps of providing an intermediate voltage-level generator coupled to a supply input and configured to generate a set of output voltages, coupling a level shifter between the intermediate voltage-level generator and the voltage regulator, the level shifter configured to generate first and second sets of control signals, applying at least one of the first and second sets of control signals at a respective input of the voltage regulator, coupling a first reference voltage to a bandgap reference generator configured to generate a bandgap reference signal and applying the bandgap reference signal to the voltage regulator.

An embodiment of a portable communication device includes a subsystem that receives and transmits information modulated in radio frequency signals. The subsystem includes an integrated voltage regulator assembly. The voltage regulator assembly includes an intermediate voltage generator, a level shifter, a bandgap reference generator, and a regulator. The intermediate voltage generator generates output voltage signals in response to a supply voltage. The level shifter is coupled to the intermediate voltage generator and generates first and second sets of control signals in response to the output voltage signals received from the intermediate voltage generator. The bandgap reference generator receives a reference signal and is coupled to at least one of the control signals. The bandgap reference generator generates a bandgap reference signal in response to the reference signal and at least one control signal from the first and second sets of control signals. The voltage regulator receives a supply voltage, bandgap reference signal and control signals from the first and second sets of control signals. The voltage regulator maintains a constant output voltage at an output under varying supply voltage levels and load conditions.

The figures and detailed description that follow are not exhaustive. The disclosed embodiments are illustrated and described to enable one of ordinary skill to make and use the low drop out voltage regulator. Other embodiments, features and advantages will be or will become apparent to those skilled in the art upon examination of the following figures and detailed description. All such additional embodiments, features and advantages are within the scope of the circuits and methods for voltage regulation as defined in the accompanying claims.

BRIEF DESCRIPTION OF THE FIGURES

The low drop out voltage regulator and method for regulating voltage can be better understood with reference to the following figures. The components within the figures are not necessarily to scale, emphasis instead being placed upon clearly illustrating the principles of the circuit and method. Moreover, in the figures, like reference numerals designate corresponding parts throughout the different views.

DETAILED DESCRIPTION

Although described with particular reference to a portable transceiver, the LDO voltage regulator assembly can be implemented in any system where it is desirable to use a voltage regulator. The LDO voltage regulator, or portions of the control system for enabling and using the LDO voltage regulator assembly, can be implemented in software, software, hardware, or a combination of software and hardware. In a preferred embodiment, the LDO voltage regulator assembly is implemented in hardware, as will be described below. The hardware portion of the invention can be implemented using specialized hardware elements and logic. Furthermore, the hardware implementation of the LDO voltage regulator can include any or a combination of the following technologies, which are all well known in the art: a discrete logic circuit(s) having logic gates for implementing logic functions upon data signals, an application specific integrated circuit having appropriate logic gates, a programmable gate array(s) (PGA), a field programmable gate array (FPGA), etc.

When control of the LDO voltage regulator assembly is implemented in software, portions of the control software may comprise an ordered listing of executable instructions for implementing logical functions, and can be embodied in any computer-readable medium for use by or in connection with an instruction execution system, apparatus, or device, such as a computer-based system, processor-containing system, or other system that can fetch the instructions from the instruction execution system, apparatus, or device and execute the instructions.

In the context of this document, a "computer-readable medium" can be any means that can contain, store, communicate, propagate, or transport the program for use by or in connection with the instruction execution system, apparatus, or device. The computer readable medium can be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection (electronic) having one or more wires, a portable computer diskette (magnetic), a random access memory (RAM), a read-only memory (ROM), an erasable programmable read-only memory (EPROM or Flash memory) (magnetic), an optical fiber (optical), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory.

Figure 1:
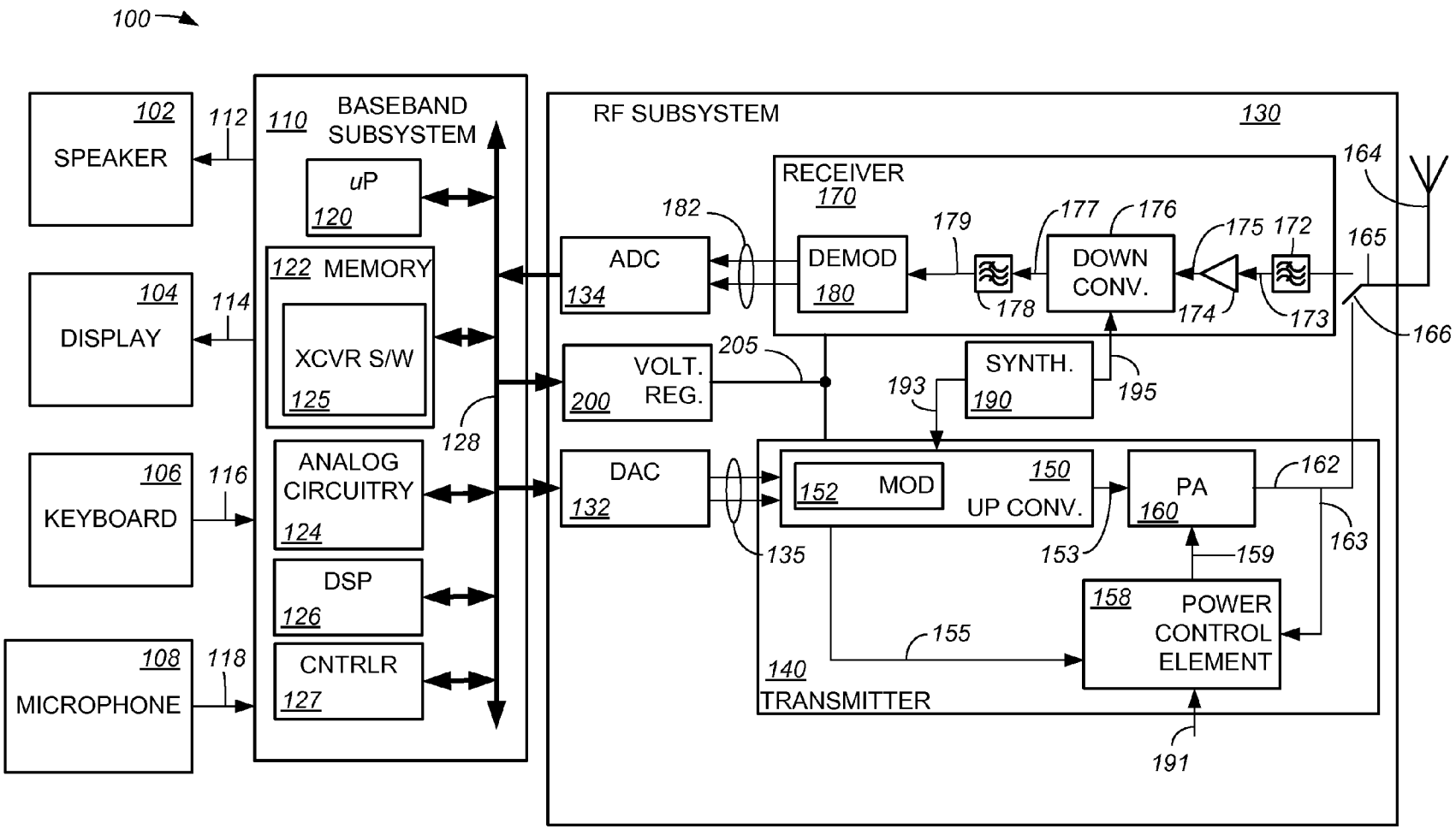
FIG. 1 is a functional block diagram of a portable device.

FIG. 1 is a block diagram illustrating a simplified portable transceiver 100. For simplicity, only basic components of portable transceiver 100 are illustrated and described. Portable transceiver 100 includes speaker 102, display 104, keyboard 106, and microphone 108, all connected to baseband subsystem 110. In a particular embodiment, the portable transceiver 100 can be, for example but not limited to, a portable telecommunication handset such as a mobile cellular-type telephone. The speaker 102 and the display 104 receive signals from the baseband subsystem 110 via connections 112 and 114, respectively, as known to those skilled in the art. Similarly, the keyboard 106 and the microphone 108 supply signals to the baseband subsystem 110 via connections 116 and 118, respectively. The baseband subsystem 110 includes microprocessor (μP) 120, memory 122, analog circuitry 124, digital signal processor (DSP) 126 and controller 127 in communication via bus 128. The bus 128, though shown as a single connection, may be implemented using a number of busses connected as necessary among the devices or subsystems within baseband subsystem 110. The microprocessor 120 and the memory 122 provide the signal timing, processing and storage functions for the portable transceiver 100. Portions of the portable transceiver 100 implemented in software are stored in memory 122. For example, in the illustrated embodiment, memory 122 includes transceiver software 125 that can be executed by microprocessor 120, DSP 126, controller 127 or by other circuits and processors communicatively coupled to memory 122.

Analog circuitry 124 provides analog processing functions for both received and internally generated signals within baseband subsystem 110. Some of these internally generated signals may be designated for transmission via radio-frequency (RF) subsystem 130. Baseband subsystem 110 communicates with RF subsystem 130 via bus 128 and signal converters. Consequently, RF subsystem 130 includes both analog and digital components. Generally, RF subsystem 130 includes transmitter 140, transmit/receive switch 165, receiver 170, and synthesizer 190. In this example, received signals are communicated from receiver 170 to baseband subsystem 110 via analog-to-digital converter (ADC) 134. Similarly, baseband subsystem processed signals are communicated from baseband subsystem 110 to transmitter 140 via digital-to-analog converter (DAC) 132.

DAC 132 may operate on either baseband in-phase (I) and quadrature-phase (Q) components or phase and amplitude components of the information signal (i.e., the signal to be transmitted) 135. In the case of I and Q signals, modulator 152 is an I/Q modulator as known in the art, while in the case of phase and amplitude components, modulator 152 operates as a phase modulator utilizing only the phase component and passes the amplitude component, unchanged, to power control element 158. One or more additional DACs (not shown)

may be added to provide control signals to various components within RF subsystem 130.

Modulator 152 modulates either the I and Q information signals or the phase information signal received from DAC 132 onto a frequency reference signal referred to as a "local oscillator" or "LO" signal provided by synthesizer 190 via connection 193. In this example, modulator 152 is part of upconverter 150, but it should be understood that modulator 152 may be separate from upconverter 150.

Modulator 152 also supplies an intermediate frequency (IF) signal containing only the desired amplitude modulated (AM) signal component for input to power control element 158 via connection 155. The AM signal supplied by modulator 152 via connection 155 is supplied to a reference variable gain element associated with power control element 158. The AM signal supplied by modulator 152 is an intermediate frequency (IF) AM signal with a constant (average) power level.

Synthesizer 190 determines the appropriate frequency to which the upconverter 150 will translate the modulated signal. Synthesizer 190 uses one or more voltage-controlled oscillators (VCOs), each operating at a center frequency of approximately 2.5 to 3.0 gigahertz (GHz) and frequency dividers to provide the desired LO signals to transmitter 140 and to receiver 170.

Upconverter 150 supplies a phase modulated signal at the appropriate transmit frequency via connection 153 to power amplifier 160. Power amplifier 160 amplifies the phase-modulated signal on connection 153 to the appropriate power level, as directed by power control element 158 via control interface 159, for transmission via connection 162 to antenna 164. Illustratively, switch 166 controls whether the amplified signal on connection 162 is transferred to antenna 164 or whether a received signal from antenna 164 is supplied to filter 172 in receiver 170. The operation of switch 166 is controlled by a control signal from baseband subsystem 110 via connection 165.

In the illustrated embodiment, a portion of the amplified transmit signal power on connection 162 can be supplied via connection 163 to power control element 158. Power control element 158, connection 159 and connection 163 combine to form a closed-loop power control system that provides a control signal on connection 159 that directs power amplifier 160 as to the power to which the signal on connection 153 should be amplified. Power control element 158 also receives an LO signal from synthesizer 190 via connection 191, which keeps power control element 158 in synchronization with the signal provided by upconverter 150.

A signal received by antenna 164 may, at the appropriate time determined by baseband subsystem 110, be directed via switch 166 to a receive filter 172. The receive filter 172 filters the received signal and supplies the filtered signal on connection 173 to a low noise amplifier (LNA) 174. Although a single LNA 174 is shown in FIG. 1, it is understood that a plurality of LNAs are typically used, depending on the frequency or frequencies on which the portable transceiver 100 operates. Receive filter 172 may be a bandpass filter that passes all channels of the particular cellular system where the portable transceiver 100 is operating. As an example, for a 1900 MHz CDMA system, receive filter 172 would pass all frequencies from 1897.5 MHz to 1902.5 MHz, covering a spread-spectrum bandwidth of 5 MHz. Receive filter 172 rejects all frequencies outside the desired region. LNA 174 amplifies the very weak signal on connection 173 to a level at which downconverter 176 can translate the signal from the received frequency to a baseband frequency. Alternatively, the functionality of the LNA 174 and the downconverter 176 can be accomplished using other elements, such as, for example but not limited to, a low noise block downconverter (LNB). In this example, the receiver 170 operates as a direct conversion receiver (DCR) in which the received RF signal is downconverted directly to a baseband signal.

Downconverter 176 receives one or more LO signals from synthesizer 190 via connection 195. Synthesizer 190 determines the frequency to which to convert the signal received from the LNA 174 via connection 175. In the case of a DCR, the received signal is converted directly to baseband frequencies (e.g., from about 100 kHz to about 630 kHz. Downconverter 176 sends the downconverted signal via connection 177 to channel filter 178. Channel filter 178 selects a desired passband to forward on connection 179 to demodulator 180. Demodulator 180 recovers the transmitted signal information (data and or voice) from a spread spectrum QPSK coded signal and supplies a signal representing this information via connection 182 to the ADC 134. ADC 134 converts these analog signals to a digital signal at baseband frequency and transfers them via bus 128 to one or more of microprocessor 120 or DSP 126 for further processing.

Figure 2:
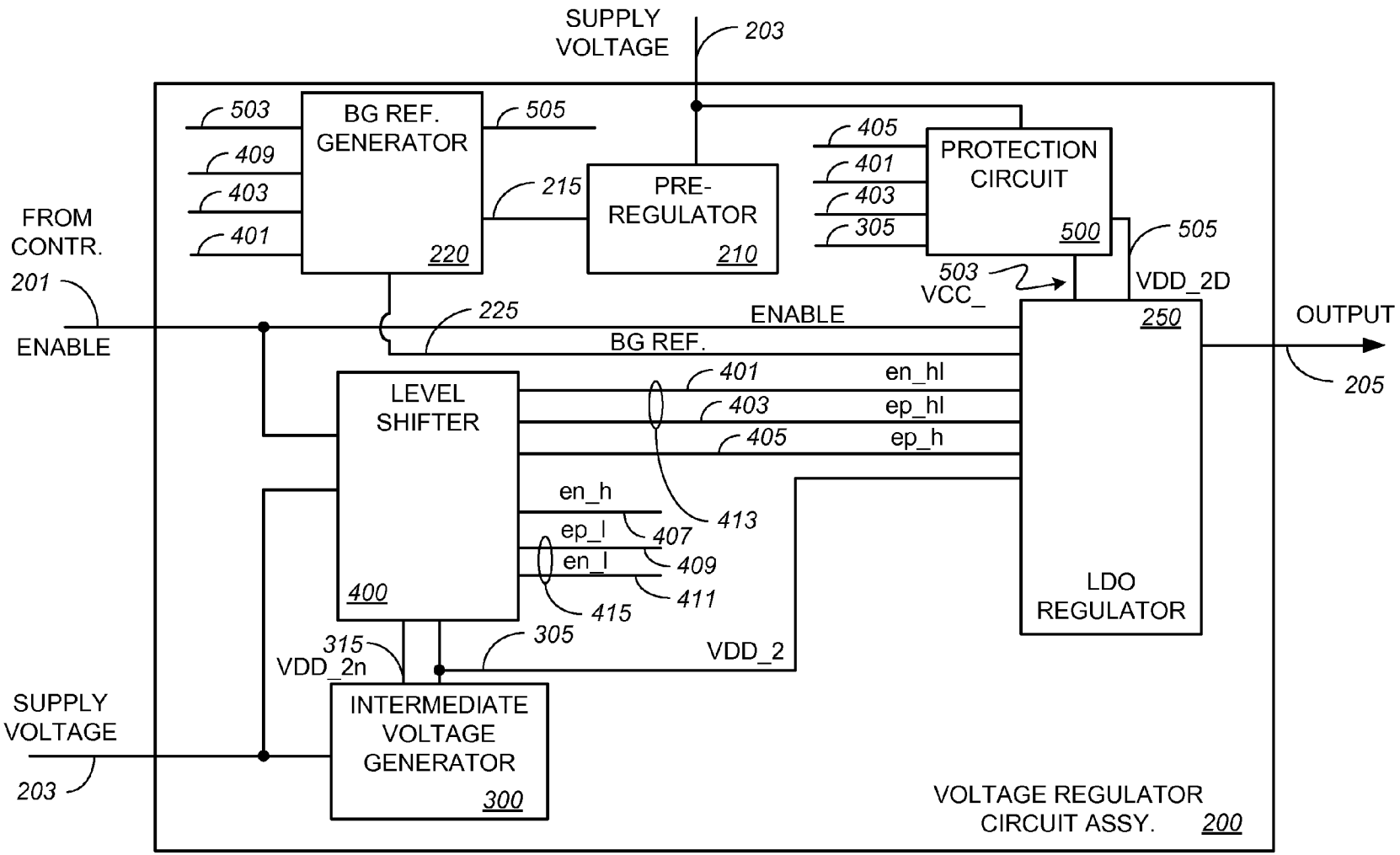
FIG. 2 is a functional block diagram of an embodiment of the integrated circuit assembly of FIG. 1.

FIG. 2 is a functional block diagram of an embodiment of the voltage regulator circuit assembly 200 of FIG. 1. Voltage regulator circuit assembly 200 (hereinafter the assembly or assembly 200) receives a supply voltage along input 203 and a regulator enable input signal from baseband subsystem 110 (i.e., controller 127) and generates a regulated voltage at a desired voltage level on output 205. In the illustrated embodiment, assembly 200 includes pre-regulator 210, bandgap reference generator 220, intermediate voltage generator 300, level shifter 400 and LDO regulator 250. Pre-regulator 210 is inserted between supply voltage at input 203 and bandgap reference generator 220 via connection 215. Pre-regulator 210 consists of an array of coupled semiconductor devices arranged to distribute any voltage level difference from the supply voltage at input 203 across the terminals of the semiconductor devices such that the voltage across any two of the terminals of a single semiconductor device does not exceed a safe operating threshold for the device. For example, in one embodiment the supply voltage as provided by a battery associated with portable transceiver 100 provides approximately 6V via input 203 to pre-regulator 210. In turn, pre-regulator 210 distributes the supply voltage across an array of positive polarity complementary metal-oxide (PMOS) field-effect transistors (FETs) to generate a first reference voltage or bandgap reference voltage of approximately 2V, which is provided to bandgap reference generator 220 via connection 215.

Intermediate voltage generator 300 is coupled between supply voltage at input 203 and level shifter 400 via connection 305 and connection 315. Intermediate voltage generator 300 converts the supply voltage into a set of output voltages. A first output voltage, labeled VDD_2, is coupled to level shifter 400, LDO regulator 250 and protection circuit 500 via connection 305. A second output voltage VDD_2*n*, is coupled to level shifter via connection 315. In one embodiment where the supply voltage is approximately 6V, VDD_2 is approximately 3V and VDD_2*n* is approximately 2V.

Level shifter 400 receives four inputs and generates six disparate output signals. Level shifter 400 is coupled between supply voltage at input 203 and intermediate voltage generator 300 via connection 305 and connection 315 and LDO regulator 250, bandgap reference generator 220 and protection circuit 500. Level shifter 400 receives the supply voltage via input 203. Input voltage VDD_2 is received via connection 305 and input voltage VDD_2*n* is received via connection 315. A regulator enable input signal is received from controller 127 via connection 201. Level Shifter 400 applies the received supply voltage and intermediate voltages (i.e., VDD_2 and VDD_2*n*) to an arrangement of PMOS FETs, negative polarity complementary metal-oxide (NMOS) FETs and diodes to generate the six disparate output signals. The six output signals are labeled ep_1, en_1, ep_h1, en_h1, ep_h and ep_n. Output signal en_h1 is distributed from level shifter 400 via connection 401 to bandgap reference generator 220, LDO regulator 250 and protection circuit 500. Output signal ep_h1 is distributed from level shifter 400 via connection 403 to bandgap reference generator 220, LDO regulator 250 and protection circuit 500. Output signal ep_h is distributed from level shifter 400 via connection 405 to LDO regulator 250 and protection circuit 500. Output signal en_h is distributed from level shifter 400 via connection 407. Output signal ep_1 is distributed from level shifter 400 via connection 409. Output signal en_1 is distributed from level shifter 400 via connection 411.

As further illustrated in FIG. 2, connection 401 and connection 403, distributing signal en_h1 and ep_h1, respectively form a first set of control signals. Connection 409 and connection 411, distributing signals ep_1 and en_1, respectively, form a second set of control signals. The first set of control signals 413 and second set of control signals 415 provide a mechanism for providing desired signals to various portions of assembly 200.

Protection circuit 500 is coupled between the supply voltage at input 203 and LDO regulator 250 via connection 503 and connection 505. Protection circuit 500 is further arranged to receive voltage VDD_2 via connection 305 and each of ep_h, en_h1 and ep_h1 control signals via connection 405, connection 401 and connection 403, respectively. Protection circuit 500 applies the received voltages and control signals to a circuit of PMOS FETs and a single NMOS FET to generate a first protection signal, labeled VCC_ and a second protection signal labeled, VDD_2D. As indicated in FIG. 2, first protection signal, VCC_, is coupled to LDO regulator 250 and bandgap reference generator 220 via connection 503. Second protection signal VDD_2D is coupled to LDO regulator 250 and bandgap reference generator 220 via connection 505. In one embodiment where the supply voltage is approximately 6V, VCC_ is 2V and VDD_2D is approximately 2V.

Bandgap reference generator 220 is coupled between protection circuit 500, pre-regulator 210, level shifter 400 and LDO regulator 250. Bandgap reference generator 220 receives first protection signal (i.e., VCC_) via connection 503 and second protection signal (i.e., VDD_2D) via connection 505. Bandgap reference generator further receives a first reference voltage via connection 215 from pre-regulator 210 as well as control signals en_h1, ep_h1, and ep_1 from connection 401, connection 403 and connection 409, respectively. As described above, bandgap reference generator generates a bandgap reference signal, which is communicated to LDO regulator 250 via connection 225.

Figure 3:
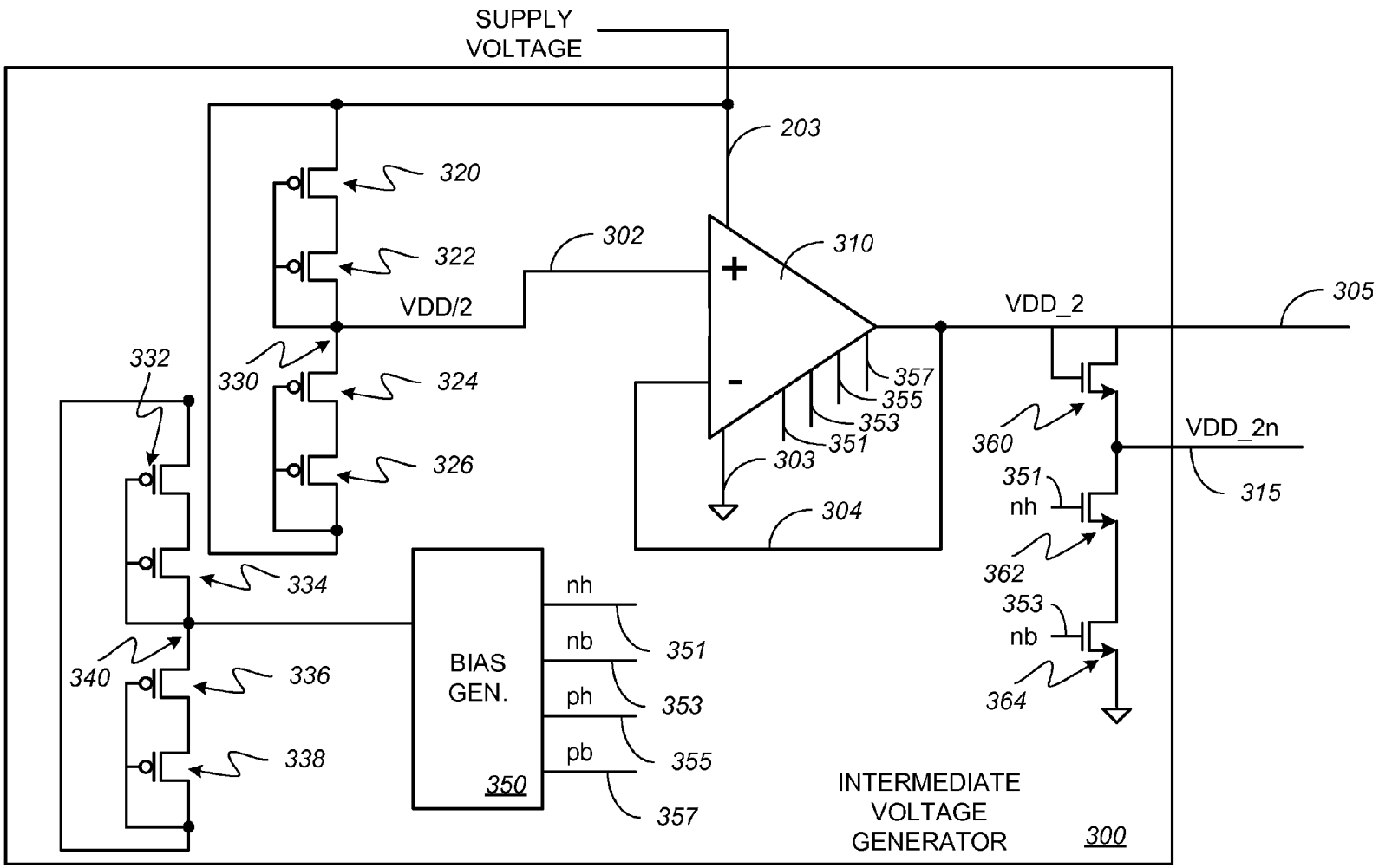
FIG. 3 is a circuit diagram illustrating an embodiment of the intermediate voltage generator of FIG. 2.

FIG. 3 is a circuit diagram illustrating an embodiment of the intermediate voltage generator 300 of FIG. 2. As illustrated in FIG. 3, intermediate voltage generator 300 includes an operational amplifier 310 and a bias generator 350. Operational amplifier 310 is coupled between a supply voltage via connection 203 and ground via connection 303. The output of operational amplifier 310 is coupled to the inverting input of the amplifier via feedback loop 304. The non-inverting input of operational amplifier 310 is coupled via connection 302 to node 330. Node 330 is interposed between first and second pairs of PMOS FETs arranged as a voltage divider. The first pair of PMOS FETs includes FET 320 and FET 322. The gate of FET 320 is coupled to the gate of FET 322, which is further coupled to node 330. The second pair of PMOS FETs includes FET 324 and FET 326. The gate of FET 320 is coupled to the gate of FET 326, which is further coupled to the supply voltage. The series coupled pairs of PMOS FETs provide a voltage at node 330, which is approximately one-half the supply voltage.

Similarly, bias generator 350 is supplied by an arrangement of series coupled PMOS FETs, which provides an input voltage to the bias generator 350 that is approximately one-half the supply voltage. A third pair of PMOS FETs includes FET 332 and FET 334. The gate of FET 332 is coupled to the gate of FET 334, which is further coupled to node 340. The fourth pair of PMOS FETs includes FET 336 and FET 338. The gate of FET 336 is coupled to the gate of FET 338, which is further coupled to the supply voltage. The series coupled pair of PMOS FETs provide a voltage at node 340, which is approximately one-half the supply voltage.

As illustrated in FIG. 3, bias generator 350 generates four outputs. A first bias output, labeled nh, is provided on connection 351. A second bias output, labeled nb, is provided on connection 353. A third bias output, labeled ph, is provided on connection 355. A fourth bias output, labeled pb, is provided on connection 357. In operation, the four bias outputs are applied to respective inputs of operational amplifier 310 to control the accuracy of output voltages VDD_2 and VDD_2*n* across a range of operating temperatures and supply voltage levels.

As further illustrated in FIG. 3, the output of operational amplifier 310 is coupled to connection 305, which provides voltage VDD_2 to LDO regulator 250, level shifter 400 and protection circuit 500. The output of operational amplifier is further coupled to the gate and source of NMOS FET 360. The drain of NMOS FET 360 is coupled to source of NMOS FET 362. The gate of NMOS FET 362 receives bias output nh via connection 315. The drain of NMOS FET 362 is coupled to the source of NMOS FET 364. The gate of NMOS FET 364 receives bias output nb via connection 353. The drain of NMOS FET 364 is coupled to ground. Connection 315 is coupled to the drain of NMOS FET 360 and the source of NMOS FET 364.

Figure 4:
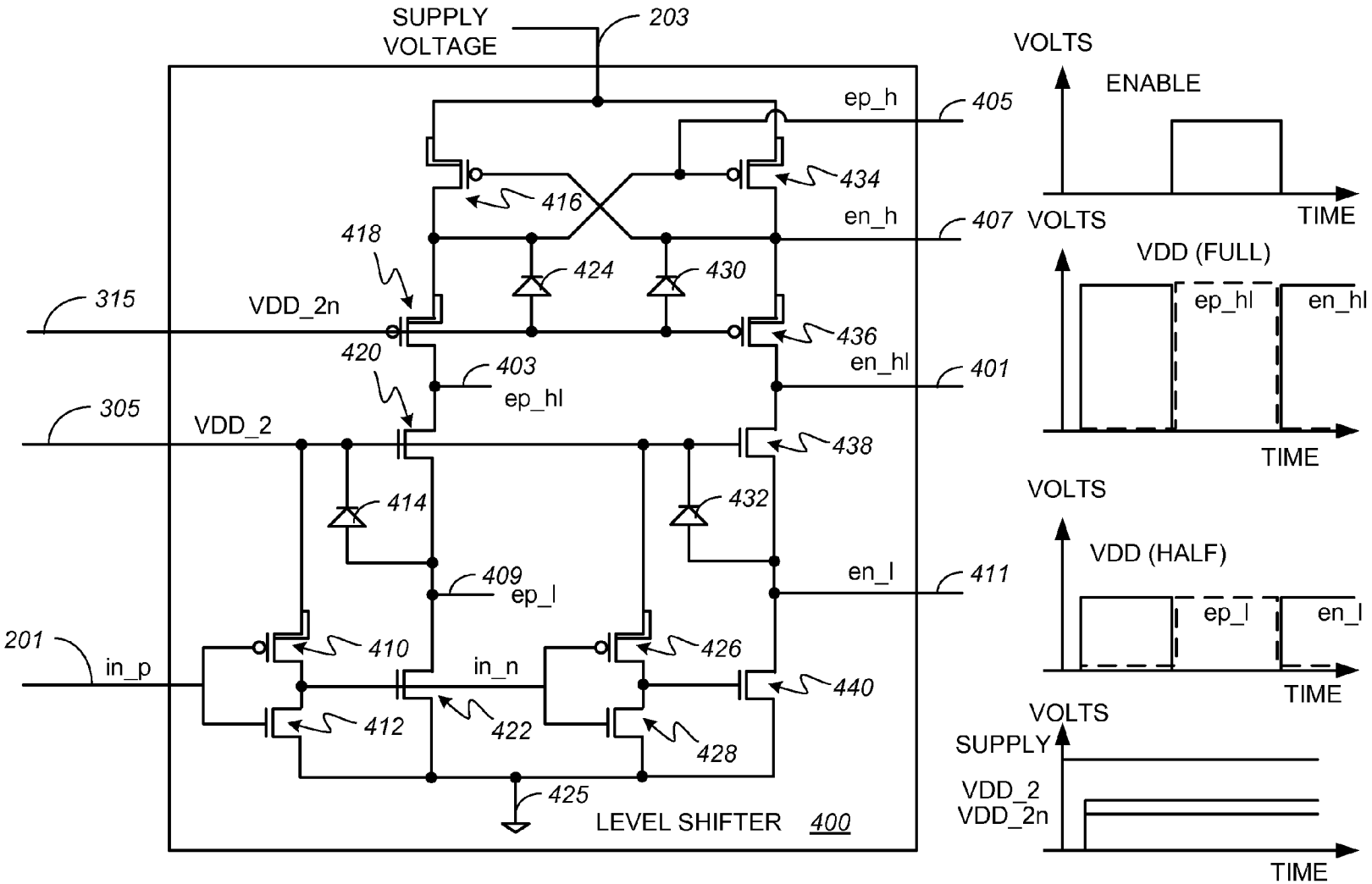
FIG. 4 is a circuit diagram illustrating an embodiment of the level shifter of FIG. 2.

FIG. 4 is a circuit diagram illustrating an embodiment of the level shifter 400 of FIG. 2. As illustrated in FIG. 4, level shifter 400 includes semiconductor devices (i.e., diodes and FETs) arranged in a complimentary manner to generate six disparate control signals (i.e., ep_h, ep_h1, ep_1, en_h, en_h1, and en_1). Level shifter 400 is responsive to three input voltages, i.e., the supply voltage, VDD_2*n* and VDD_2. The supply voltage is received on connection 203. VDD_2*n* is received on connection 315 and VDD_2 is received on connection 305. Level shifter 400 is also responsive to a differential regulator enable input signal received via connection 201. Level shifter 400 is coupled to ground via connection 425.

Level shifter 400 includes four diodes labeled diode 414, diode 424, diode 430 and diode 432. Level shifter 400 further includes six NMOS FETs (i.e., FETs 412, 420, 422, 428, 438 and 440) and six PMOS FETs (i.e., FETs 410, 416, 418, 426, 434 and 436). The supply voltage is coupled to the source of PMOS FET 416 and the source of PMOS FET 434. Voltage VDD_2*n*, provided on connection 315, is coupled to the gate of PMOS FET 418 and the gate of PMOS FET 436 as well as a first terminal of diode 424 and a first terminal of diode 430. Voltage VDD_2, provided on connection 305, is coupled to the source of PMOS FET 410, the source of PMOS FET 426, the gate of NMOS FET 420, the gate of NMOS FET 438 as well as a second terminal of diode 414 and a second terminal of diode 432. A positively polarized enable signal provided along connection 201 is coupled to the gate of PMOS FET 410 and the gate of NMOS FET 412. A negatively polarized enable signal is coupled to the gate of PMOS FET 426, the gate of NMOS FET 428, the gate of NMOS FET 422 as well as the drain of PMOS FET 410 and the source of NMOS FET 412. A ground voltage provided via connection 425 is coupled to the drains of NMOS FET 412, NMOS FET 422, NMOS FET 428 and NMOS FET 440.

Control signal ep_1 is generated at a node shared by the drain of NMOS FET 420, a first terminal of diode 414 and the source of NMOS FET 422. Control signal ep_1 is coupled to external circuits via connection 409. Control signal ep_h1 is generated at a node shared by the drain of PMOS FET 418 and the source of NMOS FET 420. Control signal ep_h1 is coupled to external circuits via connection 403. Control signal ep_h is generated at a node shared by drain of PMOS FET 416, the source of PMOS FET 418, the gate of PMOS FET 434 and a second terminal of diode 424. Control signal ep_h is coupled to external circuits via connection 405. Control signal en_h is generated at a node shared by the drain of PMOS FET 434, the source of PMOS FET 436, the gate of PMOS FET 416 and a second terminal of diode 430. Control signal en_h is coupled to external circuits via connection 407. Control signal en_h1 is generated at a node shared by the drain of PMOS FET 436 and the source of NMOS FET 438. Control signal en_h1 is coupled to external circuits via connection 401. Control signal en_1 is generated at a node shared by the drain of NMOS FET 438, the source of NMOS FET 440 and a first terminal of diode 432. As further illustrated in FIG. 4, the gate of NMOS FET 440 is coupled to the drain of PMOS FET 426 and the source of NMOS FET 428.

The plots in FIG. 4 are representative of some of the relationships between the supplied voltages and enable signal and the level shifter generated control signals. For example, the lowermost plot indicates that voltages VDD_2 and VDD_2*n* are approximately at the same voltage over time and are nearly one-half the magnitude of the supply voltage. The two innermost plots indicate that control signals en_1 and en_h1 share the opposite polarity of the enable signal in the uppermost plot. Furthermore, control signal en_1 is a time varying signal that when activated has a magnitude of approximately one-half the supply voltage. Control signal en_h1 is a time varying signal that when activated has a magnitude that is approximately equal to the supply voltage. The two innermost plots further show that control signal s ep_1 and ep_h1 share the same polarity of the enable signal in the uppermost plot. Moreover, control signal ep_1 is a time varying signal that when activated has a magnitude of approximately one-half the supply voltage. In addition, control signal ep_h1 is a time varying signal that when activated has a magnitude that is approximately equal to the supply voltage. Each of the control signals when deactivated is at approximately ground or 0V.

Figure 5:
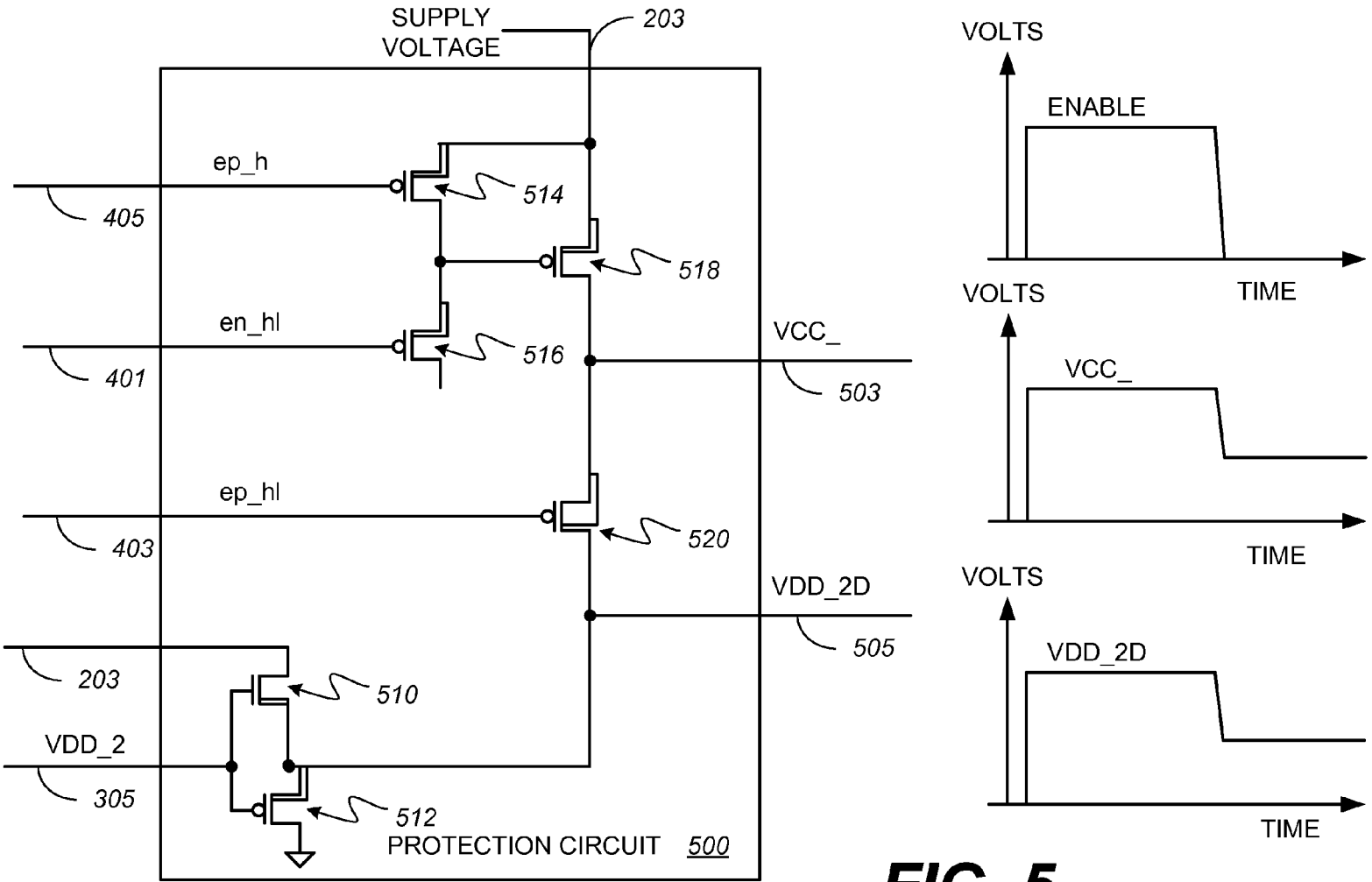
FIG. 5 is a circuit diagram illustrating an embodiment of the protection circuit of FIG. 2.

FIG. 5 is a circuit diagram illustrating an embodiment of the protection circuit 500 of FIG. 2. Protection circuit 500 includes NMOS FET 510 as well as PMOS FET 512, PMOS FET 514, PMOS FET 516, PMOS FET 518 and PMOS FET 520. The source of NMOS FET 510 is coupled to the supply voltage via connection 203. The gate of NMOS FET 510 and the gate of PMOS FET 512 are coupled to receive voltage VDD_2 via connection 305. The drain of NMOS FET 510 is coupled to the source of PMOS FET 512 and to connection 505, which supplies signal VDD_2D to LDO regulator 250 and bandgap reference generator 220. The drain of PMOS FET 512 is coupled to ground.

As further illustrated in FIG. 5, the gate of PMOS FET 514 is coupled to receive control signal ep_h via connection 405. The source of PMOS FET 514 receives the supply voltage via connection 203. The drain of PMOS FET 514 is coupled to the gate of PMOS FET 518 and the source of PMOS FET 516. The gate of PMOS FET 516 is coupled to receive control signal en_h1 via connection 401. The source of PMOS FET 518 receives the supply voltage via connection 203. The drain of PMOS FET 518 is coupled to the source of PMOS FET 520 and to connection 503, which provides signal VCC_to LDO regulator 250 and bandgap reference generator 220. The gate of PMOS FET 520 is coupled to receive control signal ep_h1 via connection 403. The drain of PMSO FET 520 is coupled to connection 505.

In operation, protection circuit 500 responds in accordance with control signals generated by level shifter 400 in response to a regulator enable signal. When the regulator enable signal is approximately 3V, protection circuit 500 responds by maintaining the output voltages at connection 503 and connection 505 at approximately the supply voltage. When the regulator enable signal is approximately 0V, protection circuit 500 responds by maintaining the output voltages at connection 503 and connection 505 at approximately 3.3V. By limiting the voltage swing from the supply voltage to approximately 3.3V in response to the change in the regulator enable signal, protection circuit 500 prevents the application of terminal voltages across semiconductor devices within regulator 250 and bandgap reference generator 220 that exceed a safe operating level.

Figure 6:
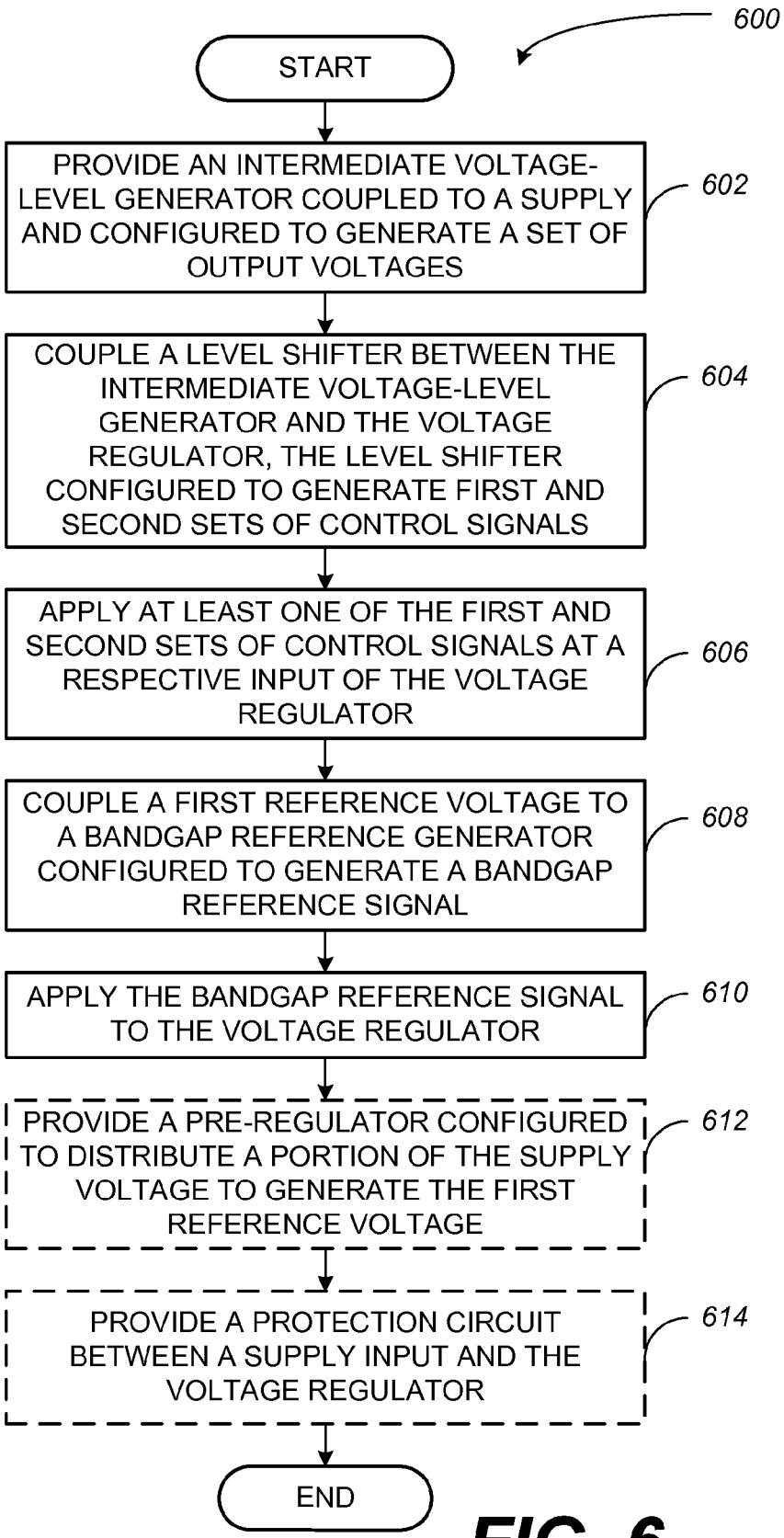
FIG. 6 is a flow chart illustrating an embodiment of a method for improving the operating supply voltage range of an integrated-circuit based voltage regulator.

FIG. 6 is a flow chart illustrating an embodiment of a method for improving the operating supply voltage range of an integrated-circuit based voltage regulator. Method 600 begins with block 602 where an intermediate voltage-level generator is coupled to a supply voltage and configured to generate a set of output voltages. As described above, the set of output voltages includes a first output voltage of approximately 3.0V and a second output voltage of approximately 2.0V. In block 604, a level shifter is coupled between the intermediate voltage-level generator and the voltage regulator. The level shifter generates first and second sets of control signals. As further described above, the first set of control signals are periodically varying signals that include a range of voltages from approximately the maximum supply voltage to 0V. The second set of control signals generated by the level shifter are periodically varying signals that include a range of voltages from approximately one-half the maximum supply voltage to 0V. Thereafter, as indicated in block 606, at least one control signal selected from the first and second sets of control signals is applied at a respective input of the voltage regulator. In block, 608, a first reference voltage is coupled to a bandgap reference generator to generate a bandgap reference signal. Thereafter, as indicated in block 610, the bandgap reference signal is applied to the voltage regulator.

As further illustrated in FIG. 6 via blocks with dashed lines, method 600 may include one or both optional steps. A first optional block 612 includes the provision of a pre-regulator configured to distribute a portion of the supply voltage to generate the first reference voltage. Accordingly, the pre-regulator would be inserted between the supply voltage and the bandgap reference generator. A second optional block 614 includes the provision of a protection circuit between the supply and an input to the voltage regulator.

While various embodiments of the low drop out voltage regulator assembly and methods for regulating voltage have been described, it will be apparent to those of ordinary skill in the art that many more embodiments and implementations are possible within the scope of this disclosure. Accordingly, the voltage regulator and methods for regulating voltage are not to be restricted except in light of the attached claims and their equivalents.

What is claimed is:

1. A method for improving the operating supply voltage range of an integrated-circuit based voltage regulator, the method comprising:

coupling a level shifter to a voltage regulator, the level shifter configured to generate first and second sets of periodic control signals; and applying at least one of the first and second sets of control signals at a respective input of the voltage regulator.

2. The method of claim 1, further comprising:

providing a pre-regulator coupled to a supply input and configured to distribute a portion of the supply voltage present at the supply input to generate a first reference voltage; and applying the first reference voltage to the voltage regulator.

3. The method of claim 2, wherein providing the pre-regulator comprises providing a network of semiconductor devices arranged such that a respective voltage difference between terminals of devices in the network of semiconductor devices is within a reliability threshold.

4. The method of claim 1, further comprising providing an intermediate voltage-level generator coupled to a supply input and configured to generate a set of output voltages such that each member of the set has respective voltage levels lower in magnitude than a supply voltage level and higher in magnitude than a target output level of the voltage regulator.

5. The method of claim 1, wherein coupling a level shifter to the voltage regulator comprises generating the first set of signals to support an output voltage swing that approximates the magnitude of the supply voltage.

6. The method of claim 1, wherein coupling a level shifter to the voltage regulator comprises generating the second set of signals to support an output voltage swing that approximates one-half the magnitude of the supply voltage.

7. The method of claim 1, wherein coupling a level shifter to the voltage regulator comprises controlling the level shifter in response to a regulator input signal.

8. The method of claim 1, further comprising:

providing a protection circuit coupled between a supply input and an input to the voltage regulator.

9. The method of claim 8, wherein providing a protection circuit further comprises controlling the protection circuit with at least one of the output voltages from an intermediate voltage level generator.

10. The method of claim 8, wherein providing a protection circuit further comprises controlling the protection circuit with a signal from the first and second sets of control signals.

11. An integrated circuit assembly for managing voltage regulation where a supply voltage exceeds a reliability threshold associated with the manufacturing process used to implement the circuit assembly, comprising:

a level shifter configured to generate first and second sets of control signals; and a voltage regulator configured with a supply input for receiving a supply voltage, control signal inputs for receiving the first and second sets of control signals from the level shifter and an output, the voltage regulator configured to maintain a constant output voltage under varying supply voltage levels.

12. The integrated circuit assembly of claim 11, further comprising:

a pre-regulator coupled to a supply input and configured to distribute a portion of the supply voltage present at the supply input to generate a reference voltage for application at a reference voltage input of the voltage regulator.

13. The integrated circuit assembly of claim 12, wherein the pre-regulator comprises a network of semiconductor devices arranged such that a respective voltage difference between terminals of devices in the network of semiconductor devices is within a reliability threshold.

14. The integrated circuit assembly of claim 11, wherein each of the first and second sets of control signals has a respective voltage level that is greater in magnitude than a target output level of the voltage regulator.

15. The integrated circuit assembly of claim 11, wherein the first set of control signals from the level shifter support an output voltage swing that approximates the magnitude of the supply voltage.

16. The integrated circuit assembly of claim 11, wherein the second set of control signals from the level shifter support an output voltage swing that approximates one-half the magnitude of the supply voltage.

17. The integrated circuit assembly of claim 11, wherein the level shifter comprises an input configured to receive a regulator enable input signal.

18. The integrated circuit assembly of claim 11, further comprising:

a protection circuit coupled between the supply input and an input to the voltage regulator.

19. The integrated circuit assembly of claim 18, wherein the protection circuit is configured to receive at least one signal from the first and second sets of control signals.

20. The integrated circuit assembly of claim 18, wherein the protection circuit is configured to receive at least one of the output voltages from an intermediate voltage level generator.

21. A portable communication device, comprising:

a subsystem configured to transmit and receive information modulated in radio frequency signals, the subsystem configured with an integrated voltage regulator assembly comprising:

a level shifter configured to generate first and second sets of periodic control signals; and a voltage regulator configured with a supply input for receiving a supply voltage, control signal inputs for receiving the first and second sets of control signals from the level shifter and an output, the voltage regulator configured to maintain a constant output voltage at the output under varying supply voltage levels.

* * * * *